US005871380A

United States Patent [19]

Claussen

[11] Patent Number: 5,871,380

[45] Date of Patent: Feb. 16, 1999

[54] INTERCOOLER FOR THE STERN DRIVE OF A BOAT

[76] Inventor: Dean Claussen, 16355-C San Carlos Blvd., Fort Myers, Fla. 33908

[21] Appl. No.: 928,548

[22] Filed: Sep. 12, 1997

[51] Int. Cl.[6] ..... B63H 21/10

[52] U.S. Cl. ..... 440/88

[58] Field of Search ..... 440/75, 76, 88, 440/89

[56] References Cited

U.S. PATENT DOCUMENTS 4,950,190 8/1990 Meisenburg ..... 440/88
4,959,033 9/1990 Bland et al. ..... 440/76
5,236,380 8/1993 Schueller et al. ..... 440/88
5,340,345 8/1994 Brodbeck et al. ..... 440/88

*Primary Examiner*—Stephen Avila
*Attorney, Agent, or Firm*—William E. Noonan

[57] ABSTRACT

An intercooler for the stern drive of a boat engine includes a cover that is attached to the stern drive housing. The cover includes an inner compartment, which communicates internally with the stern drive and accommodates lubricating oil used by the stern drive. An outer jacket is disposed adjacent the compartment. Ambient water is introduced into and discharged from the water jacket such that the ambient water circulates through the jacket to cool the inner compartment and the oil contained therein.

20 Claims, 4 Drawing Sheets

INTERCOOLER FOR THE STERN DRIVE OF A BOAT

FIELD OF THE INVENTION

This invention relates to an intercooler for the stern drive of a boat engine and, more particularly, to a device for lowering the operating temperature of the stern drive so that increased power and performance and an extended operating life are achieved.

BACKGROUND OF THE INVENTION

Performance oriented boaters typically wish to obtain the greatest power output possible. However, the output produced by most boat engines is limited by the stern drive unit. This unit transmits the power from the boat's motor to the propeller shaft. It houses the vessel's clutch and U-joint assemblies, as well as various gears and bearings. These components undergo tremendous stresses and strains as the engine is operated. Accordingly, a standard oil reservoir is used to lubricate the drive components and minimize wear. Nonetheless, over time and particularly under heavy use, the oil deteriorates. Eventually, the internal components of the stern drive, such as the top bearing, become misaligned and fatigued. No matter how carefully it is maintained, the stern drive will fail at some point. High performance boat engines are particularly susceptible to premature stern drive problems because of the extreme heat generated in the drive. Indeed, in many high performance engines, the oil temperature approaches 290 degrees Fahrenheit.

To date, the stern drive has been cooled by allowing it to be sprayed by the surrounding (ambient) water. This technique has generally not proven to be satisfactory. Stern drives, and particularly those used in high performance watercraft, still exhibit an undesirably high and premature rate of failure. Frequent and costly stern drive repairs are a relatively commonplace problem.

SUMMARY OF INVENTION

It is therefore an object of the present invention to provide an intercooler for the stern drive of a boat engine, which significantly cools the drive during operation so that the operating life of the drive is prolonged.

It is a further object of this invention to provide a stern drive intercooler that is incorporated directly into the cover of the drive.

It is a further object of this invention to provide a stern drive intercooler that operates reliably and efficiently and which requires virtually no maintenance or repair.

It is a further object of this invention to provide a stern drive intercooler that operates virtually automatically to reduce the oil temperature of the stern drive each time the boat engine is operated.

It is a further object of this invention to provide a stern drive intercooler that is effective for use on virtually all boat engines and which is particularly effective for use in high-performance boat engines.

It is a further object of this invention to provide a stern drive intercooler that may be quickly and inexpensively retrofit on existing boat engines.

It is a further object of this invention to provide a stern drive intercooler, which permits boat engines to be effectively adapted to produce higher power outputs.

This invention features an intercooler for the stern drive of a boat engine. The intercooler includes a cover that is attached to the housing of the stern drive. The cover includes means defining an inner compartment, which communicates internally with the stern drive and accommodates lubricating oil used by the stern drive. The cover also includes means defining an outer water jacket disposed adjacent the compartment. There are means for introducing the ambient water into and discharging that water from the water jacket such that the ambient water circulates through the jacket to cool the inner compartment and the oil contained therein.

In a preferred embodiment, the water jacket includes chamber formed in the cover and the compartment includes a wall that interengages the chamber. The chamber preferably has a tapered, cross sectional shape. The cover may include a casing having an interior cavity. The wall is attached to the casing within the cavity and extends through the cavity to define the compartment on one side of the wall and the water jacket chamber on the opposite side of the wall.

The means for introducing and discharging may include an inlet and an outlet connected to the chamber and extending through the cover. The means for introducing may also include means defining a pick-up tube attached to the inlet and having entry port means disposed in a body of ambient water such that water is forced through the pick-up tube to the inlet when the boat and the tube are moved through the water. The entry port means may be formed at an acute angle to the longitudinal axis of the tube. Means may be provided for mounting the tube in a generally vertical condition with the entry port generally facing in the direction in which the boat travels. The means for mounting may include a bracket secured to the tube and means for attaching the bracket to a cavitation plate of the stern drive. The inlet may also extend at least partially through the stern drive.

This invention also features an intercooler for a stern drive of a boat engine, wherein the stern drive includes an external housing having a removable cover. The intercooler includes means carried by the cover for defining an inner compartment, which communicates internally with the stern drive and which accommodates a lubricating oil used by the stern drive. The cover also carries means defining an outer water jacket disposed adjacent to the compartment. There are means for introducing and discharging water into and out of the water jacket in the manner described above.

DETAILED DESCRIPTION OF PREFERRED EMBODIMENTS

Other objects, features and advantages will occur from the following description of preferred embodiments and the accompanying drawings, in which.

Figure 1:
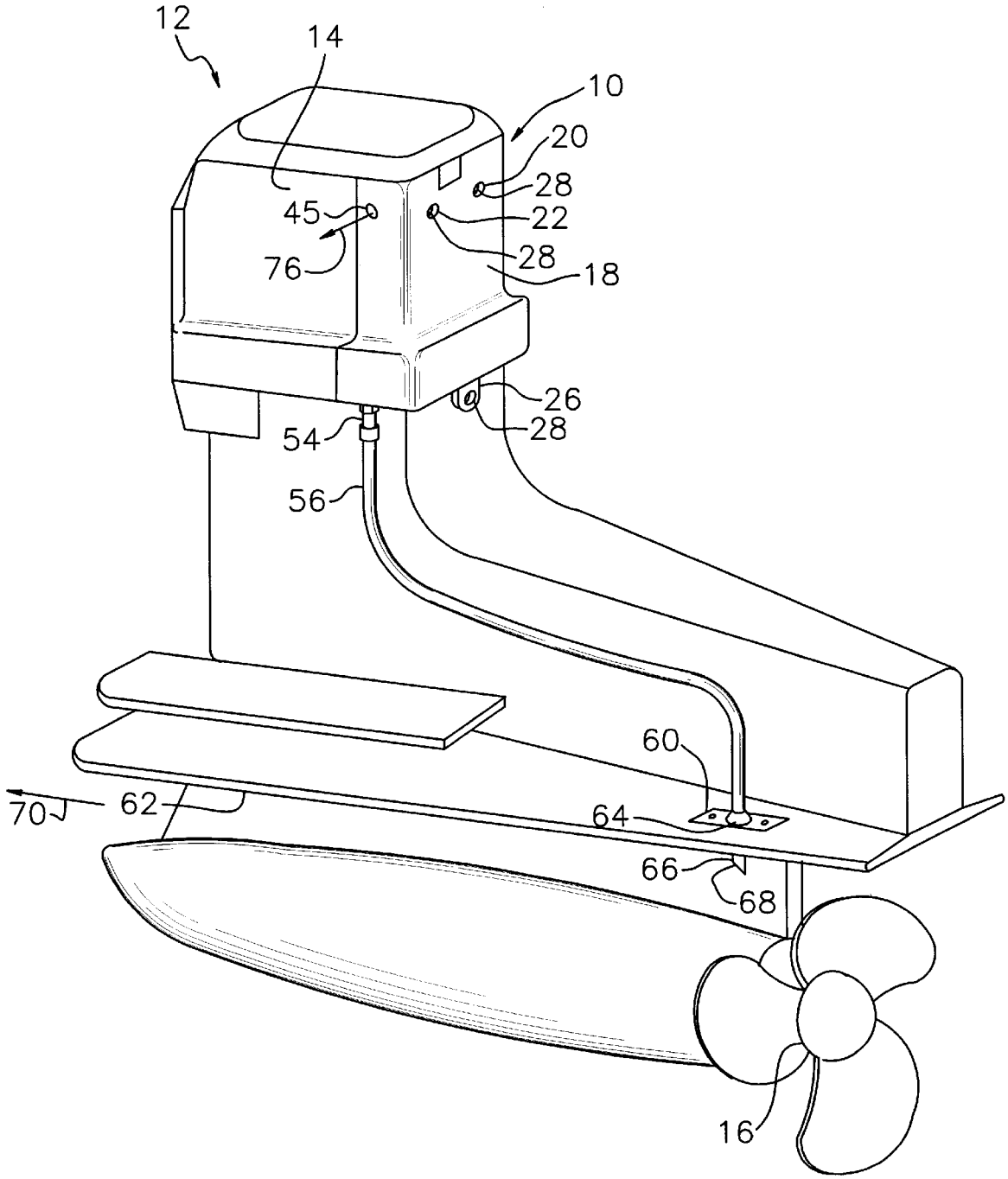
FIG. 1 is a perspective view of a stern drive equipped with the intercooler of this invention.

There is shown in FIG. 1 a stern drive intercooler apparatus 10 that is used in conjunction with a stern drive 12. The stern drive is an otherwise conventional apparatus of the type manufactured, for example, by Mercury Marine™. It should be understood, however, that the intercooler of this invention may be employed with other types of stern drives.

The stern drive, which is largely enclosed by a housing 14, operably interconnects the boat's motor with propeller shaft 16 in a conventional manner. The particular structural features of the drive, including the U-joint, clutch and assorted gears and bearings, are standard and not comprise a part of this invention.

Figure 2:
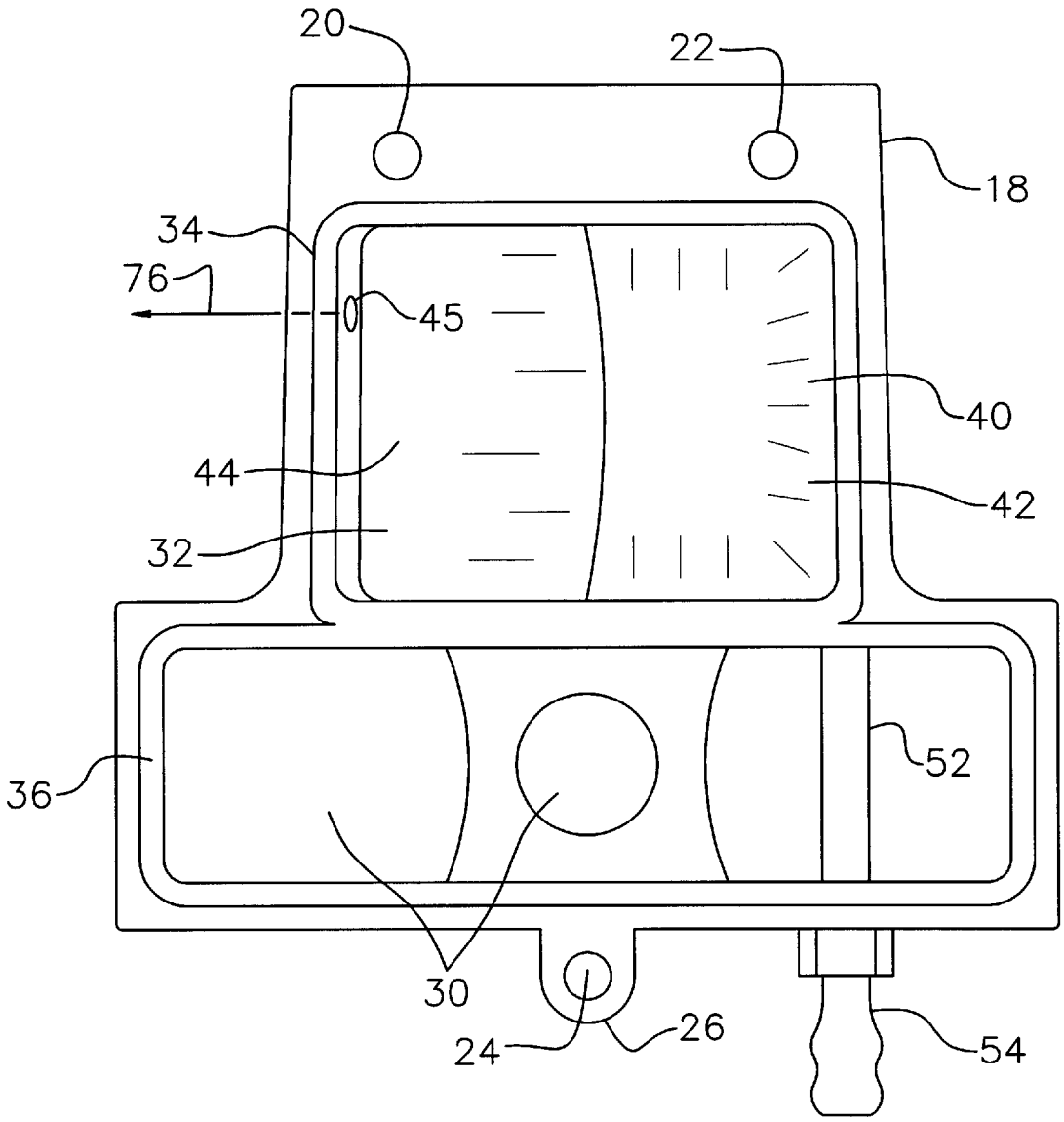
FIG. 2 is an elevational interior view of a stern drive cover that is equipped with an intercooler according to this invention; the oil accommodating compartment is broken away to illustrate the water jacket.

Intercooler 10 includes a casing or cover 18, which is shown removed from housing 14 in FIG. 2. Cover 18 typically comprises the standard stern drive cover normally found on engine 12. It is composed of a high strength metal or metal alloy that is cast or otherwise formed using known manufacturing techniques. Cover 18 includes a pair of upper holes 20 and 22 and a lower hole 24 formed in a flange 26. These holes are aligned with corresponding holes on housing 14 and receive respective bolts 28 to secure the cover to housing 14 in the known manner best shown in FIG. 1. As shown in FIG. 2, cover 18 includes lower recesses 30 that accommodate the stern drive shifter in a conventional manner. A cavity 32 is formed in the upper part of housing 18, above recesses 30. In most conventional stern drives, cavity 32 accommodates oil, which lubricates the shifter and other operating components of the stern drive. A gasket accommodating channel 34 surrounds cavity 32. A similar gasket accommodating channel 36 surrounds recesses 30. When cover 18 is placed against motor 14, channels 34 and 36 hold respective gaskets or O-rings (not shown) to seal the inside of the stern drive against water intrusion. The gaskets also prevent oil from leaking out of the stern drive.

Figure 3:
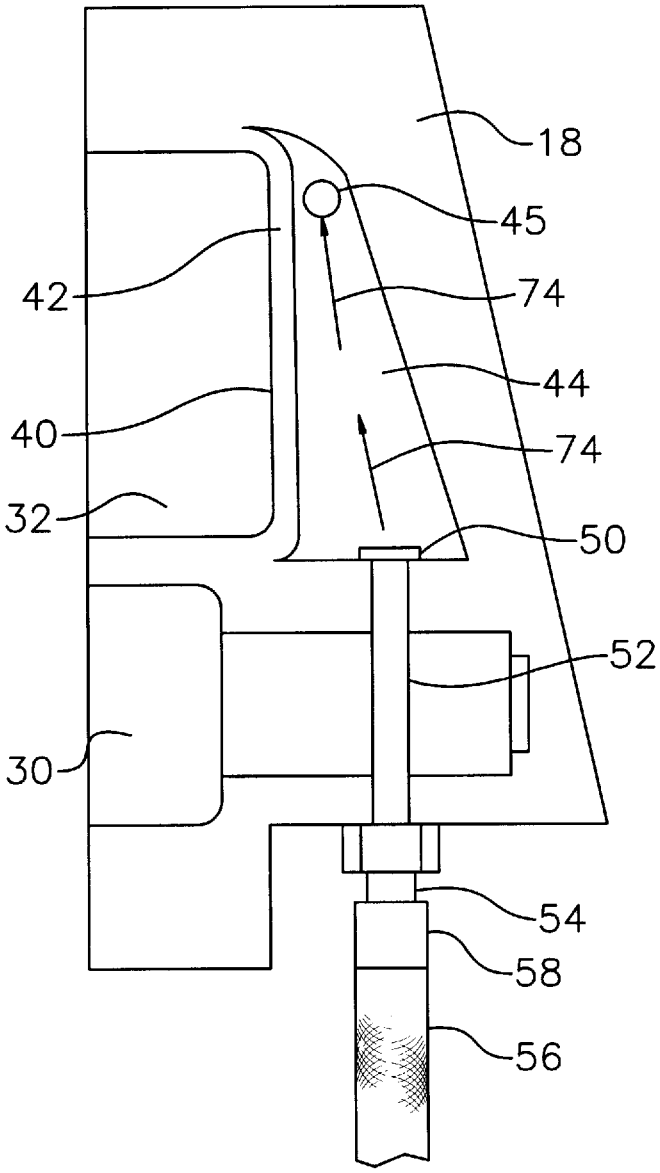
FIG. 3 is an elevational, cross sectional side view of the stern drive cover and intercooler according to FIG. 2.

An inner, oil accommodating compartment 40 is formed within housing 18 and, more particularly, within cavity 32. An aluminum wall or insert 42, approximately half of which is shown, is secured to cover 18. As shown in FIGS. 2 and 3, wall 42 may be formed unitarily with the body of cover 18. Alternatively, it may comprise a separate piece that is welded or otherwise fixed within the cover. In either event, wall 42 extends across cavity 32 and forms compartment 40 on the side facing inwardly toward the motor. When cover 18 is engaged against and attached to motor 14, compartment 40 accommodates lubricating oil used by the stern drive.

An outer water jacket 44 is formed by the portion of cavity 32 located on the opposite side of dividing wall 42. As shown in FIGS. 2 and 3, the water jacket comprises a largely enclosed chamber having a tapered, cross sectional shape that converges from bottom to top. The thickness of wall 42, which separates compartment 40 from chamber 44, is approximately 0.0050 inches. An outlet port 45 is connected to water jacket chamber 44 through one side of the housing. This outlet port may be formed at various locations. For example, it is shown in the left-hand side of the housing in FIG. 1, but is alternatively illustrated in the right-hand side of the housing in FIGS. 2 and 3.

Figure 4:
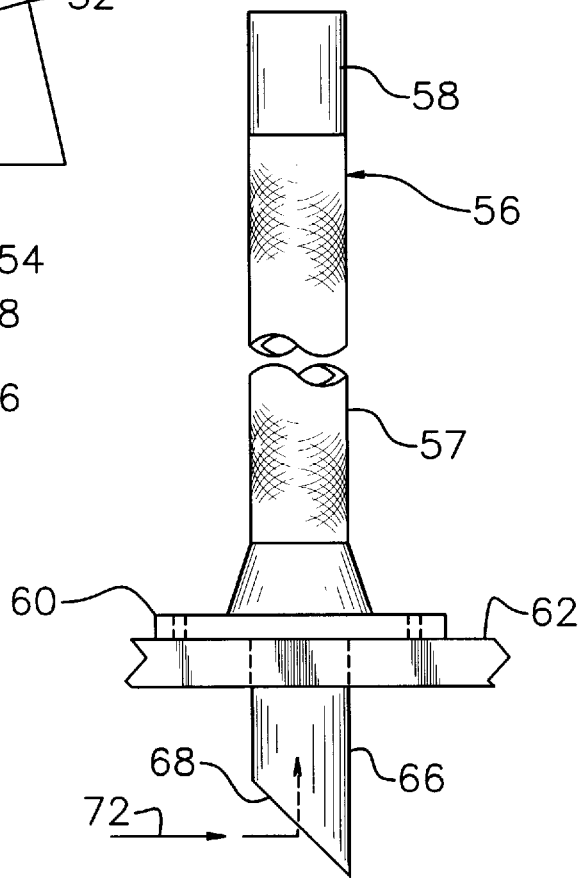
FIG. 4 is an elevational view of the pick-up tube mounted to the cavitation plate.
Figure 5:
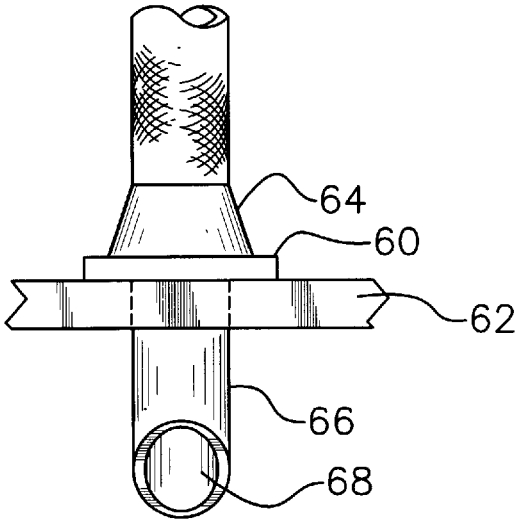
FIG. 5 is an elevational front view of the lower end of the pick-up tube taken at a right angle to the view illustrated in FIG. 4.
Figure 6:
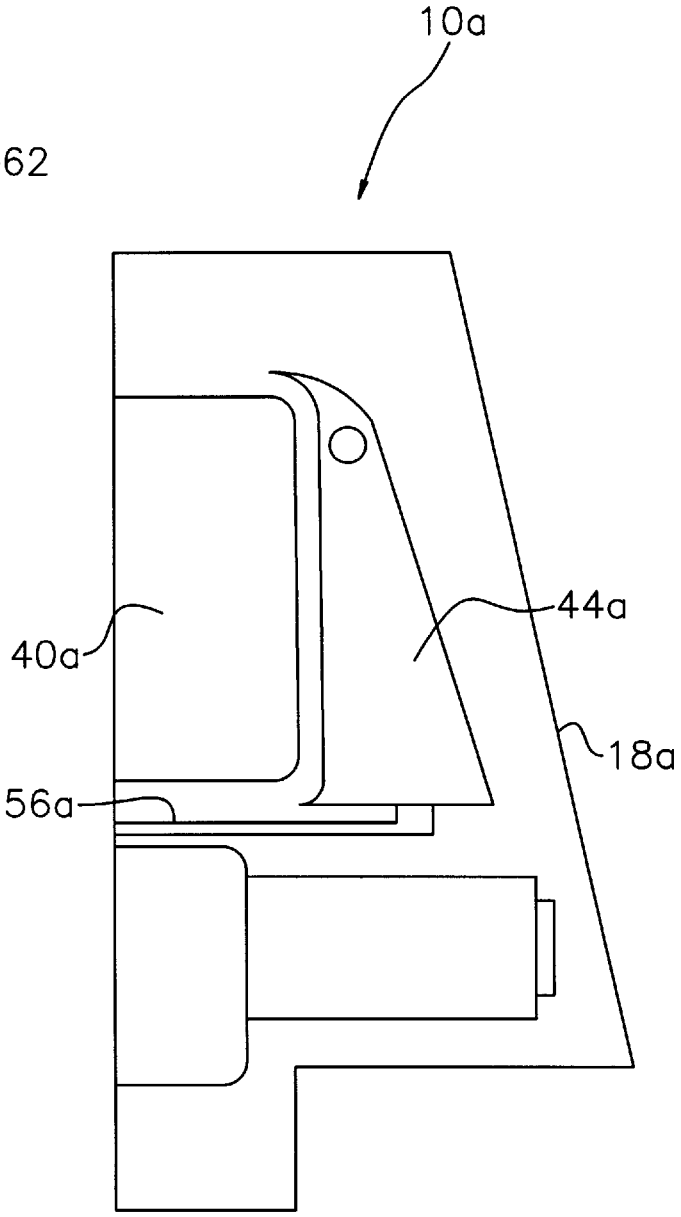
FIG. 6 is an elevational, cross sectional view of a stern drive that employs an alternative, integral inlet for introducing ambient water into the water jacket.

Ambient water, i.e. water drawn from the body of water in which the boat is located, is introduced into water jacket 44 through an inlet 50, best shown in FIG. 3. Inlet 50 is interconnected by an elongate tube 52 to a fitting 54 that depends from housing 18. See FIGS. 1–3. Fitting 54 is communicably interconnected by a pick-up tube 56, FIGS. 1, 3 and 4. Tube 56 include a flexible portion 57 composed of interwoven stainless steel fibers. A fitting 58 at the upper end of tube 56 communicably interconnects fitting 54 and tube 56. As illustrated in FIGS. 1, 4 and 6, tube 56 is interconnected by a bracket 60 to the cavitation plate 62 of stern drive 12. Tube 56 extends through a bushing 64 that is carried by plate 60. A lower tube portion 66 extends through the cavitation plate and depends therefrom. See FIGS. 1, 4 and 5. An entry port 68 is formed at the lower end of tube portion 66. More particularly, the lower end of tube 66 is cut at an acute angle relative to the longitudinal axis of the pick-up tube. As a result, entry port 68 faces in a generally forward direction, as best illustrated in FIG. 1.

Intercooler 10 is connected to stern drive 12 by attaching cover 18 to housing 14. Standard stern drives that do not include the intercooler thus may be retrofit with the product of this invention. Initially, the standard stern drive cover is removed and replaced by cover 18. Holes 20, 22 and 24 are aligned with the preexisting openings in the stern drive housing. Bolts 28 are attached to secure the housing in place. Pick-up tube 56 is then assembled. The upper end of the pick-up tube is secured to fitting 54. Bracket 60 secures the pick-up tube to the cavitation plate in the manner previously described. It should be noted that in alternative embodiments, a bracket may secure the lower end of the pick-up tube adjacent to, rather than through, the cavitation plate. In such cases, a hole does not need to be formed through the cavitation plate to accommodate the depending tube segment 66.

In operation, stern drive 12 drives the boat in the direction indicated by arrow 70, FIG. 1. Water is force fed through entry port 68 and into pick-up tube 56, as indicated by arrows 72 in FIG. 4. The ambient water is forced through the pick-up tube and through inlet 50 into water jacket chamber 44, FIG. 3. As illustrated by arrows 74, the water circulates through the water jacket and is discharged therefrom through outlet port 45, as shown by arrows 76, FIGS. 1 and 2. The ambient water absorbs heat from compartment 40 through dividing wall 42. As a result, the oil within compartment 42 and the component parts of the stern drive are cooled. Ambient water continues to be circulated through water jacket 44 as long as the engine drives the boat through the water. This significantly reduces the temperature within the stern drive and consequent wear on the stern drive parts. In fact, the intercooler reduces the oil temperature by approximately 60–80 degrees. Because the stern drive is maintained in a cooled condition, the oil resists premature deterioration and frequent and costly stern drive failures are reduced. The life of the stern drive is improved considerably and a high output performance is achieved.

FIG. 6 illustrates an alternative embodiment of this invention, wherein intercooler 10*a* includes an inlet tube 56*a* that is formed internally through housing 18*a*. Intercooler 10*a* again includes an oil accommodating compartment 40*a* and a water jacket chamber 44*a*, which are constructed and function analogously to the components in the previously described version. In this embodiment, tube 56*a* is formed through the stern drive and cover 18*a*, and extends beneath compartment 40*a*. The drive itself has a water pick up tube, not shown, for collecting engine cooling water.

As in the prior embodiment, the water enters the water jacket chamber through the inlet tube and is circulated through the chamber to cool oil accommodating compartment 40. As a result, stern drive wear is reduced and stern drive life is prolonged.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. An intercooler for a stern drive, which stern drive includes a housing, said intercooler comprising:

a cover that is attached to the stern drive housing, said cover including an inner compartment, which communicates internally with the stern drive and accommodates lubricating oil used by the stern drive, and an outer water jacket disposed adjacent said compartment; and means for introducing ambient water into said water jacket and discharging said water from said jacket such that the ambient water circulates through said jacket to cool said inner compartment and the oil contained therein; said means for introducing and discharging including an inlet and an outlet connected to said water jacket and extending through said cover and further including a pick-up tube communicably connected to said inlet and having an entry port disposed in a body of ambient water such that water is forced through said pick-up tube to said inlet when said boat and said tube are moved through the water.

2. The intercooler of claim 1 in which said water jacket includes a chamber formed in said cover and said compartment includes a wall that interengages said chamber.

3. The intercooler of claim 2 in which said cover includes a casing having an interior cavity, said wall being attached to said casing within said cavity and extending through said cavity to define said compartment on one side of said wall and said water jacket chamber on an opposite side of said wall.

4. The intercooler of claim 1 in which said entry port is formed at an acute angle to the longitudinal axis of said tube.

5. The intercooler of claim 4 further including means for mounting said tube in a generally vertical condition with said entry port generally facing in the direction in which the boat travels.

6. The intercooler of claim 5 in which said means for mounting include a bracket secured to said tube and means for attaching said bracket to a cavitation plate of the boat engine.

7. The intercooler of claim 2 in which said chamber has a tapered cross sectional shape.

8. The intercooler of claim 1 in which said means for introducing includes an inlet and outlet connected to said chamber, said inlet extending at least partially through the stern drive.

9. The intercooler of claim 1 in which said cover is removably attached to the stern drive housing.

10. An intercooler for a stern drive, which stern drive includes an external housing having a removable cover, said intercooler comprising: an inner compartment carried by said housing, which compartment communicates internally with the stern drive and accommodates lubricating oil used by the stern drive;

an outer water jacket carried by said cover and disposed adjacent said compartment; and means for introducing ambient water into said water jacket and discharging the water from said jacket such that the ambient water circulates through said jacket to cool said inner compartment and the oil contained therein; said means for introducing and discharging including an inlet and an outlet connected to said water jacket and extending through said cover and further including a pick-up tube communicably connected to said inlet and having an entry port disposed in a body of ambient water such that water is forced through said pick-up tube to said inlet when said boat and said tube are moved through the water.

11. The intercooler of claim 10 in which said water jacket includes a chamber formed in said cover and said compartment includes a wall that interengages said chamber.

12. The intercooler of claim 10 in which said entry port is formed at an acute angle to the longitudinal axis of said tube.

13. The intercooler of claim 12 further including means for mounting said tube in a generally vertical condition with said entry port generally facing in the direction in which the boat travels.

14. The intercooler of claim 13 in which said means for mounting include a bracket secured to said tube and means for attaching said bracket to a cavitation plate of the boat engine.

15. The intercooler of claim 11 in which said chamber has a tapered cross sectional shape.

16. The intercooler of claim 10 in which said means for introducing includes an inlet and outlet connected to said chamber, said inlet extending at least partially through the stern drive.

17. An intercooler for the stern drive of a boat engine, which stern drive includes housing, said intercooler comprising:

a cover that is removably attached to a generally rearwardly facing portion of the stern drive housing, said cover including a lower interior recess that accommodates a conventional shifter mounted in the stern drive housing and a separate and distinct upper interior cavity located above said recess, said cavity including a concave inner compartment, which communicates internally with the stern drive housing and accommodates lubricating oil used by the stern drive, and an outer water jacket disposed adjacent said compartment; and means for introducing ambient water into said water jacket and discharging said water from said jacket such that the ambient water circulates through said jacket to cool said inner compartment and the oil contained therein.

18. The intercooler of claim 17 in which said means for introducing and discharging include an inlet and outlet connected to said water jacket and extending through said cover.

19. The intercooler of claim 17 in which said water jacket comprises a chamber having a tapered cross-sectional shape.

20. The intercooler of claim 17 in which said means for introducing and discharging includes an inlet and an outlet connected to said water jacket, said inlet extending at least partially through the stern drive.

* * * * *